US011786009B2

(12) United States Patent
Javed

(10) Patent No.: US 11,786,009 B2
(45) Date of Patent: Oct. 17, 2023

(54) FOOTWEAR SYSTEM WITH INTEGRATED ORTHOTICS, STABILIZATION FEATURES, AND A PLURALITY OF DESIGN FEATURES

(71) Applicant: Najwa Javed, Fremont, CA (US)

(72) Inventor: Najwa Javed, Fremont, CA (US)

( * ) Notice: Subject to any disclaimer, the term of this patent is extended or adjusted under 35 U.S.C. 154(b) by 0 days.

(21) Appl. No.: 17/344,890

(22) Filed: Jun. 10, 2021

(65) Prior Publication Data

US 2021/0386159 A1 Dec. 16, 2021

Related U.S. Application Data

(60) Provisional application No. 63/037,599, filed on Jun. 11, 2020.

(51) Int. Cl.
*A43B 13/14* (2006.01)

(52) U.S. Cl.
CPC ..... *A43B 13/14* (2013.01)

(58) Field of Classification Search
CPC ..... A43B 13/14; A43B 13/026; A43B 17/003; A43B 7/14
See application file for complete search history.

(56) References Cited

U.S. PATENT DOCUMENTS 1,467,296 A * 9/1923 Anderson ..... A43B 7/142 36/76 R
2,025,650 A * 12/1935 Deuker ..... A43B 7/142 36/172
2,366,096 A * 12/1944 Gerber ..... A43B 7/142 36/155
2,729,900 A * 1/1956 Maccarone ..... A43B 7/1445 36/76 R
5,373,650 A * 12/1994 Dananberg ..... A43B 7/14 36/43
5,782,015 A * 7/1998 Dananberg ..... A43B 7/1425 36/35 B
7,594,346 B2 * 9/2009 Dananberg ..... A43B 7/141 36/180
7,962,986 B2 * 6/2011 Dananberg ..... A43B 7/14 36/180
8,800,171 B1 * 8/2014 Khaitan ..... A43B 7/1435 36/28
8,813,391 B1 * 8/2014 Khaitan ..... A43B 7/1435 36/28
8,869,429 B1 * 10/2014 Zsolcsak ..... A43B 7/1445 36/2.6
9,833,040 B2 * 12/2017 Khaitan ..... A43B 1/0045
10,130,139 B2 * 11/2018 Parke ..... A43B 7/142
10,264,850 B2 * 4/2019 Lam ..... A43B 17/006
10,390,587 B2 * 8/2019 Hughes ..... A43B 7/148
2004/0211086 A1 * 10/2004 Dananberg ..... A43B 7/143 36/43

(Continued)

*Primary Examiner* — Bao-Thieu L Nguyen

(57) ABSTRACT

A footwear system with integrated orthotics and a plurality of design features is presented. The present disclosure relates generally to a footwear system. More specifically, and without limitation, the present disclosure relates to a footwear system with integrated orthotic and design features. More specifically, the present disclosure is a bi-layered orthotic device integrated into fashionable footwear. Additionally, and without limitation, the present disclosure is a device which provides flexibility in use, functionality, and appearance improvements to the state of the art.

17 Claims, 18 Drawing Sheets

(56) References Cited

U.S. PATENT DOCUMENTS

| | | | | |
|---|---|---|---|---|
| 2005/0050771 | A1* | 3/2005 | Dananberg | A43B 7/38 36/43 |
| 2008/0016724 | A1* | 1/2008 | Hlavac | A43B 13/125 36/30 R |
| 2009/0193683 | A1* | 8/2009 | Igdari | A43B 7/142 36/43 |
| 2009/0255148 | A1* | 10/2009 | Dananberg | A43B 7/142 36/180 |
| 2012/0000093 | A1* | 1/2012 | Pata | A43B 13/188 36/88 |
| 2016/0143393 | A1* | 5/2016 | Parke | A43B 7/141 36/44 |
| 2016/0206038 | A1* | 7/2016 | Parke | A43B 7/141 |
| 2018/0008002 | A1* | 1/2018 | Yick | A43B 7/14 |
| 2019/0261732 | A1* | 8/2019 | Hughes | A43B 23/07 |
| 2020/0015547 | A1* | 1/2020 | Kay | A43D 3/021 |
| 2022/0183419 | A1* | 6/2022 | Pham | A43B 17/006 |

* cited by examiner

FOOTWEAR SYSTEM WITH INTEGRATED ORTHOTICS, STABILIZATION FEATURES, AND A PLURALITY OF DESIGN FEATURES

CROSS-REFERENCE TO RELATED APPLICATIONS

The present application claims priority to the U.S. Provisional Patent Application No. 63/037,599 which was filed on Jun. 11, 2020, which is hereby incorporated by reference herein in its entirety, including any figures, tables, or drawings.

FIELD OF THE DISCLOSURE

The present disclosure relates generally to a footwear system. More specifically, and without limitation, the present disclosure relates to a footwear system with an integrated orthotic and design features. More specifically, the present disclosure is a bi-layered orthotic device integrated into fashionable footwear. Additionally, and without limitation, the present disclosure is a device which provides flexibility in use, functionality, and appearance improvements to the state of the art. However, the present disclosure is not limited to these novel and inventive improvements, and it may further be adapted for a variety of purposes.

COPYRIGHT NOTICE

At least a portion of the disclosure of this patent document contains material that is subject to copyright protection. The copyright owner has no objection to the facsimile reproduction by anyone of the patent document or the patent disclosure, as it appears in the Patent and Trademark Office patent files and/or records, but otherwise reserves all copyright rights whatsoever. The following notice applies to the software and data as described below and in the drawings that form a part of this document: Copyright Najwa Javed. All rights reserved.

BACKGROUND OF THE DISCLOSURE

The present disclosure relates generally to orthotic foot devices. The present disclosure relates to foot devices to be worn on the foot of a user. The present disclosure relates generally to a footwear system. More specifically, and without limitation, the present disclosure relates to a footwear system with integrated orthotic and design features. More specifically, the present disclosure is a bi-layered orthotic device integrated into fashionable footwear. Additionally, and without limitation, the present disclosure is a device which provides flexibility in use, functionality, and appearance improvements to the state of the art. However, the present disclosure is not limited to these novel and inventive improvements, and it may further be adapted for a variety of purposes.

Orthotics are well known in the art. In general, orthotics are devices that provide a support or brace for the foot, and more typically, both feet. Conventional orthotics are in the form of removable inserts that are placed inside a shoe after the orthotic has been measured, calibrated, and customized for a user.

A number of orthotics, or shoe inserts extend along only a portion of the foot, for example, from the heel of the foot of a user to the ball of the foot of a user or even beyond and curling around the end of the toes of the foot of a user. In this way, typical orthotics extend the entire length of the foot of a user. These full inserts and/or partial inserts can provide some support for a user, but tend to have a loose fit and often slip inside the shoe.

Slippage within a shoe may be in one, or a combination, of slippage types. The users foot may slip on the orthotic from front to back or side to side. Additionally, the orthotic itself may slip within the foot such that the interior or anterior of the orthotic slides up the wall of the shoe. In this way, the benefits of an orthotic are often negated, simply as a result of orthotic slippage, due to the nature of orthotic operation.

What are known as full-length inserts, in the art, are less likely to slip than partial inserts due to their size. However, full length inserts are bulky and crowd the users foot within a shoe. Oftentimes once an insert is placed within a shoe, there is no longer enough space within the interior of the shoe for a user to be able to fit her foot. In this way, full length inserts are especially bulky, and often not used or discarded. More often, due to bulkiness, once the insert is placed in one shoe, it is never reused in another shoe, and a user tends to stop using the squished shoe.

Some orthotic inserts do offer an affixed position within the interior of a shoe by applying a glue and/or another adhesive. This may add even more weight and bulkiness to the process, is often messy, and usually never satisfying. Additionally, inserts can vary from material to material. Some inserts are broken down by glues. Inserts that aren't broken down by an adhesive often break down quickly under the wear and tear of a user taking thousands of steps each and every day.

Flexible materials such as elastomers, which is a very common material for inserts, include a u-shaped heel pad and sometimes an arch support. Similarly, these elastomers tend to break down quickly, losing their integrity as a heel or arch support. Other materials are rigid materials such as hard plastics or rubbers. While these rigid materials may not break down as quickly as an elastomer, they are often uncomfortable and a nuisance due to the bulkiness and hardness scale factor.

During repeated use throughout the day, the foot of a user absorbs tremendous forces when engaging in a weight bearing activity. Weight bearing activities may include simple activities such as walking, standing and moving about a space. Other, more complex weight bearing activities include, but are not limited to, running, jumping, and changing directions quickly.

Typically, when a user walks or runs, and/or engages in other weight-bearing activities the outer part of their heel strikes the ground first in a supinated position. This may vary from user to user and the type of shoe being worn. For some users, the inner part of the heel may hit the ground first. For other users, and other shoe types a more simultaneous striking may occur. As a person moves and engages in the weight-bearing activities, their weight is transferred front to back and side to side. Support becomes critical at the shoe and foot level, not only in foot health but body health.

In foot health, the weight of the body tends to cause arches of feet to flatten when under compression forces of the human body. The forces may be release and a tension is created almost instantly before compressive forces are re-applied in simple activities such as walking. The foot is often flattened and lengthened repeatedly thousands of times per day. This continuous stress on the outer, inner, and throughout the foot can cause ligaments, tendons, and muscles in the foot to sprain, tear, or deteriorate. For this reason, orthotics do help the health of a foot. Additionally, orthotics tend to help the entire body as knees, hips, back and other joints and parts of the human body can be affected by the gait and support caused by shoes and/or weight bearing movements of a user.

Although some conventional orthotic inserts provide some support and alleviate some of these issues, these devices are designed for use with tennis shoes or sneakers. Even in these simplest of applications, the orthotics tend to be dysfunctional, raising the foot too high outside of the shoe or causing the top of the foot to stretch out the shoe. In this way, even the simplest of shoes become unfashionable and unusable.

In addition, orthotics are heavy, which quickly deteriorate performance in both athletic activities and prolonged weight bearing activities. Heavy orthotics multiply their weight by thousands of times throughout the ordinary day of a user taking thousands of steps. A heavy orthotic can tire out a user, consuming energy. Furthermore, modern orthotics, for the reasons mentioned above, tend to fail to hold their position and be uncomfortable.

The present invention solves these problems as well as a host of other problems with modern orthotics. Thus, it is a primary objective of the present invention to provide a lightweight, comfortable orthotic capable of holding its position. Furthermore, it is the primary object of this invention to provide footwear with an integrated orthotic so that the orthotic is not subject to slippage and other common orthotic issues. Furthermore, it is a primary objective to provide footwear with an integrated orthotic for a high heel. This is a complex challenge that the present disclosure provides solutions to. Furthermore, it is a primary object of the disclosure to provide footwear with an integrated orthotic that is comfortable, stable, provides injury prevention, is fashionable, is aesthetically pleasing, is functional, reusable, and more. The present disclosure is directed toward providing these solutions and more.

SUMMARY OF THE DISCLOSURE

The purpose of this disclosure is to provide the state of the art with an orthotic footwear system which provides for an increased functionality and flexibility. Said another way, the purpose of the present disclosure is to provide a revolutionary footwear that incorporates a carbon fiber orthotic within each design. Additionally, the present disclosure is intended to provide an orthotic footwear with a restructured arch incline. Additionally, the purpose of the present disclosure is to provide the art with a toe box, or integrated toe box, which allows for the anatomical stabilization of a user wearing a high heel.

In other words, the purpose of the present disclosure is to provide a high heel, a fashionable high heel, with a fashionable appearance, but with an integrated orthotic structure and stabilization structure which allows for orthotic use within the high heel as well as stabilization of the foot within the high heel. These features, providing stabilization, removing risk of injury, and structurally enhancing the foot in a plantar-flexed position, will become apparent in the present disclosure.

The present disclosure provides a carbon fiber inlay that is medically designed to improve the gait of a user. Additionally, the carbon fiber inlay can be customized to an individual users needs, if necessary. The carbon fiber inlay, in addition to the features and components herein and without limitation, is designed to have a concave heel cup. In this way, a 4 degree medial arch inversion, and a flared and dorsiflexed anterior rim provide for stabilization, injury prevention, and the like. This improves the gait of a user while also improving posture, impact, and more associated with movement of a user.

In the present disclosure, as will become apparent, some of the above features are achieved, while maintaining a fashionable design, and making an orthotic possible with a high heeled footwear through an elongated, deepened toe box. This elongated, deepened toe box has also been widened to allow for needed toe space, not only for functionality, but also comfort. While comfort and appearance have been maximized, fashion, and appearance have not been sacrificed through clever design, research, testing, and development.

Furthermore, the arrangement disclosed herein, and as will become more apparent from the disclosure, a unique design of a toe spring raises the nose of the shoe at a 15 degree dorsiflexed integration. Other angles are also hereby contemplated for use. This particular arrangement, through careful and meticulous design, research, and development along with other features of the shoe provide for optimized footwear in achieving comfort, health, and appearance.

Another feature developed for the disclosure through meticulous design and research is the 46 degree arch incline which provides a variety of enhancements and purposes as will become more apparent. The arch incline is critical in perfecting and may be achieved through a variety of angles, but not without research and an exact calibration which integrates the other features and components disclosed herein.

Furthermore, the present disclosure includes a design for an antislip, embedded sole within the shoe to provide additional stabilization, prevent slips of the sole within the footwear itself, and provide for comfort. The disclosure herein includes a rubber component and design, however, the design is not limited to this material or particular shape, which has been determined to optimize slip reduction and enhance comfort.

In combination with convenience, appearance, ease of use, enhanced method of use, longevity for lack of reduction of the supporting materials, the present disclosure offers a health solution to those existing in the art, which prevents a user, needing or wanting orthotics, but not using orthotics due to a lack of footwear choice, fashion, and loss of appearance qualities of existing shoes. Furthermore, the present disclosure provides a mass producible solution to providing orthotics within fashionable footwear, along with the other features and components herein.

Through a solution that incorporates convenience, health, gait, chiropractic, comfort, foothealth, injury prevention, stabilization advantages and more, along with functionality advantages, as well as proper deployment, the disclosure herein presents a much improved, novel, and needed orthotic footwear solution.

Thus, it is a primary object of the disclosure to provide a footwear system with integrated orthotics, stabilization features, and a plurality of design features that improves upon the state of the art.

Another object of the disclosure is to provide a footwear system with integrated orthotics, stabilization features, and a plurality of design features that provides orthotic footwear.

Yet another object of the disclosure is to provide a footwear system with integrated orthotics, stabilization features, and a plurality of design features that provides an orthotic.

Another object of the disclosure is to provide a footwear system with integrated orthotics, stabilization features, and a plurality of design features that incorporates a carbon fiber orthotic.

Yet another object of the disclosure is to provide a footwear system with integrated orthotics, stabilization features, and a plurality of design features that incorporates a carbon fiber orthotic into a footwear line.

Another object of the disclosure is to provide a footwear system with integrated orthotics, stabilization features, and a plurality of design features that provides a restructured arch incline.

Yet another object of the disclosure is to provide a footwear system with integrated orthotics, stabilization features, and a plurality of design features that provides a restructured arch incline for anatomically stabilizing a heel.

Another object of the disclosure is to provide a footwear system with integrated orthotics, stabilization features, and a plurality of design features that provides a novel toe box.

Yet another object of the disclosure is to provide a footwear system with integrated orthotics, stabilization features, and a plurality of design features that provides a novel toe box for anatomically stabilizing a heel.

Another object of the disclosure is to provide a footwear system with integrated orthotics, stabilization features, and a plurality of design features that provides a restructured arch incline and novel toe box for anatomically stabilizing a heel.

Yet another object of the disclosure is to provide a footwear system with integrated orthotics, stabilization features, and a plurality of design features that anatomically stabilizes a high heel.

Another object of the disclosure is to provide a footwear system with integrated orthotics, stabilization features, and a plurality of design features that reduces risk of injury for a user.

Yet another object of the disclosure is to provide a footwear system with integrated orthotics, stabilization features, and a plurality of design features that improves foot health.

Another object of the disclosure is to provide a footwear system with integrated orthotics, stabilization features, and a plurality of design features that improves ankle health.

Yet another object of the disclosure is to provide a footwear system with integrated orthotics, stabilization features, and a plurality of design features that provides support for a users foot as it sits in a plantar-flexed position.

Another object of the disclosure is to provide a footwear system with integrated orthotics, stabilization features, and a plurality of design features that provides a carbon inlay orthotic.

Yet another object of the disclosure is to provide a footwear system with integrated orthotics, stabilization features, and a plurality of design features that is medically designed.

Another object of the disclosure is to provide a footwear system with integrated orthotics, stabilization features, and a plurality of design features that has a concave heel cup.

Yet another object of the disclosure is to provide a footwear system with integrated orthotics, stabilization features, and a plurality of design features that provides a 4 degree medical arch inversion.

Another object of the disclosure is to provide a footwear system with integrated orthotics, stabilization features, and a plurality of design features that provides a flared anterior rim.

Yet another object of the disclosure is to provide a footwear system with integrated orthotics, stabilization features, and a plurality of design features that provides a dorsiflexed anterior rim.

Another object of the disclosure is to provide a footwear system with integrated orthotics, stabilization features, and a plurality of design features that provides an elongated toe box.

Yet another object of the disclosure is to provide a footwear system with integrated orthotics, stabilization features, and a plurality of design features that provides a deepened toe box.

Another object of the disclosure is to provide a footwear system with integrated orthotics, stabilization features, and a plurality of design features that provides a widened toe box.

Yet another object of the disclosure is to provide a footwear system with integrated orthotics, stabilization features, and a plurality of design features that provides more toe space within a toe box.

Another object of the disclosure is to provide a footwear system with integrated orthotics, stabilization features, and a plurality of design features that provides a built in toe spring.

Yet another object of the disclosure is to provide a footwear system with integrated orthotics, stabilization features, and a plurality of design features that provides a built in toe spring raising the nose of a shoe to a dorsiflexed position.

Another object of the disclosure is to provide a footwear system with integrated orthotics, stabilization features, and a plurality of design features that provides a build in toe spring raising the nose of a shoe to a dorsiflexed position of 15 degrees.

Yet another object of the disclosure is to provide a footwear system with integrated orthotics, stabilization features, and a plurality of design features that provides an arch incline.

Another object of the disclosure is to provide a footwear system with integrated orthotics, stabilization features, and a plurality of design features that provides an arch incline that is 46 degrees.

Yet another object of the disclosure is to provide a footwear system with integrated orthotics, stabilization features, and a plurality of design features that provides an anti slip rubber embedded feature.

Another object of the disclosure is to provide a footwear system with integrated orthotics, stabilization features, and a plurality of design features that provides an anti slip feature.

Yet another object of the disclosure is to provide a footwear system with integrated orthotics, stabilization features, and a plurality of design features that provides an anti slip feature within the sole of the shoe.

Another object of the disclosure is to provide a footwear system with integrated orthotics, stabilization features, and a plurality of design features that is stable.

Yet another object of the disclosure is to provide a footwear system with integrated orthotics, stabilization features, and a plurality of design features that is fashionable.

Another object of the disclosure is to provide a footwear system with integrated orthotics, stabilization features, and a plurality of design features that is unique.

Yet another object of the disclosure is to provide a footwear system with integrated orthotics, stabilization features, and a plurality of design features that is easy to use.

Another object of the disclosure is to provide a footwear system with integrated orthotics, stabilization features, and a plurality of design features that is safe.

Yet another object of the disclosure is to provide a footwear system with integrated orthotics, stabilization features, and a plurality of design features that improves the orthopedic health of a user.

Another object of the disclosure is to provide a footwear system with integrated orthotics, stabilization features, and a plurality of design features that improves the health of a user.

Yet another object of the disclosure is to provide a footwear system with integrated orthotics, stabilization features, and a plurality of design features that improves the safety of a user.

Another object of the disclosure is to provide a footwear system with integrated orthotics, stabilization features, and a plurality of design features that aids in preventing injury.

Yet another object of the disclosure is to provide a footwear system with integrated orthotics, stabilization features, and a plurality of design features that is orthotic.

Another object of the disclosure is to provide a footwear system with integrated orthotics, stabilization features, and a plurality of design features that is convenient.

Yet another object of the disclosure is to provide a footwear system with integrated orthotics, stabilization features, and a plurality of design features that is lightweight.

These and other objects, features, or advantages of the present disclosure will become apparent from the specification and claims.

DETAILED DESCRIPTION OF THE DISCLOSURE

Figure 1:
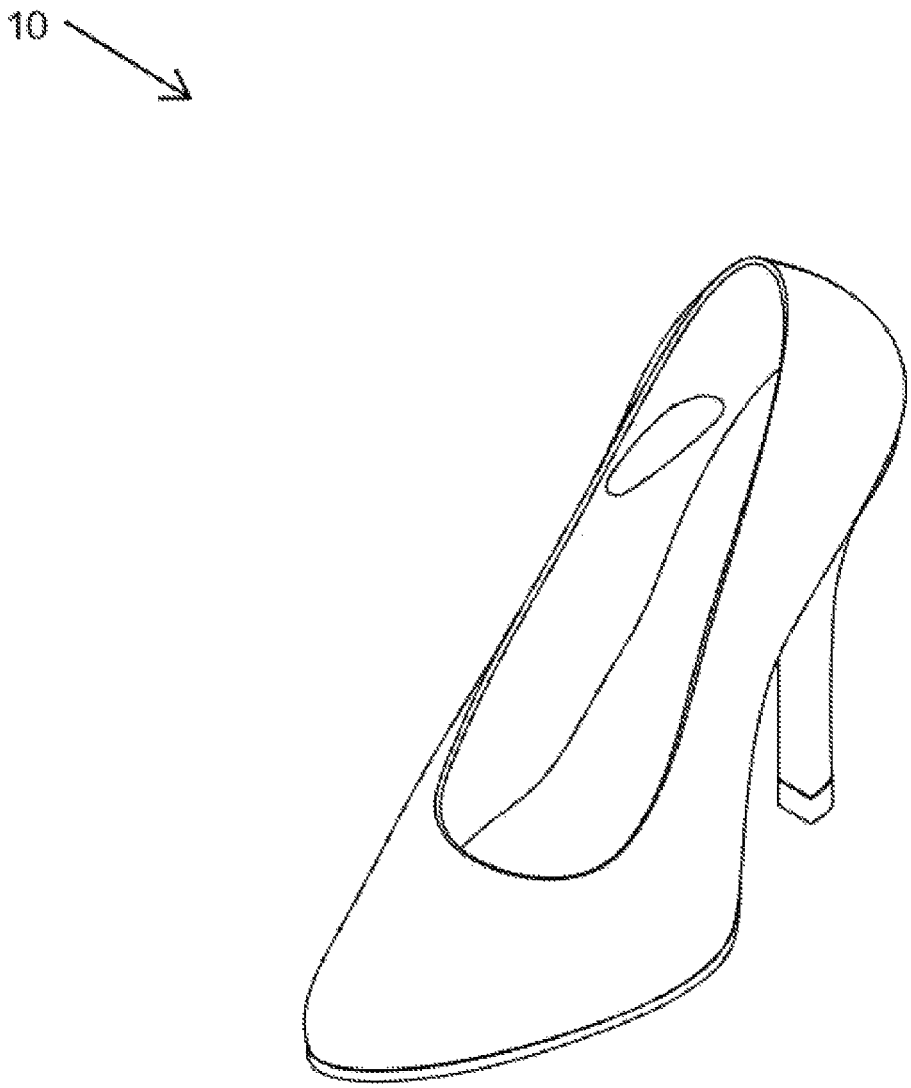
FIG. 1 is a top, perspective view of the footwear system with integrated orthotics, stabilization features, plurality of design features, and method of use; the view showing a footwear system and/or shoe and/or heeled shoe; the view showing an orthotic system in place within the shoe.
Figure 2:
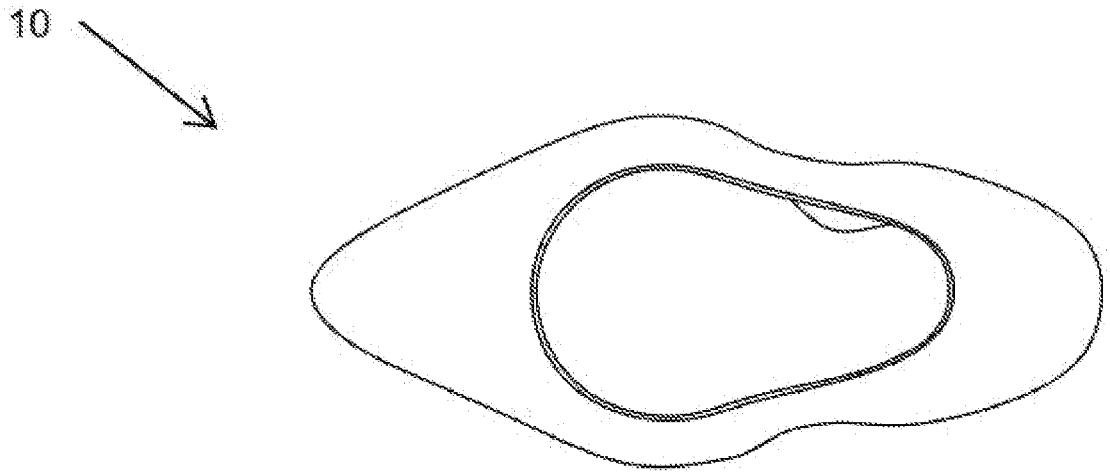
FIG. 2 is a top view of the footwear system with integrated orthotics, stabilization features, plurality of design features, and method of use; the view showing a footwear system and/or shoe and/or heeled shoe; the view showing an orthotic system in place within the shoe.
Figure 3:
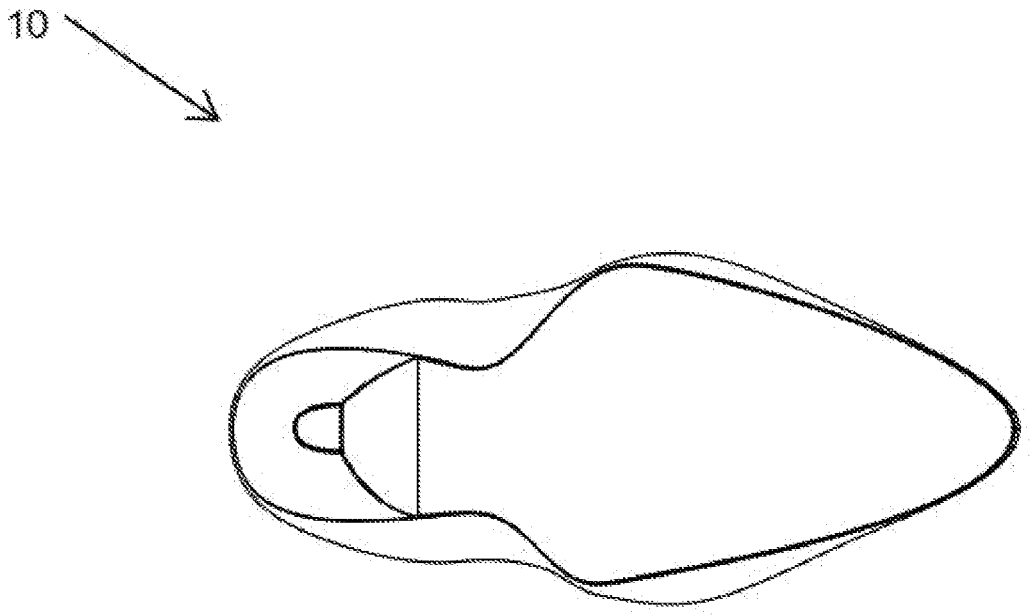
FIG. 3 is a view of the footwear system with integrated orthotics, stabilization features, plurality of design features, and method of use; the view showing a footwear system and/or shoe and/or heeled shoe.
Figure 4:
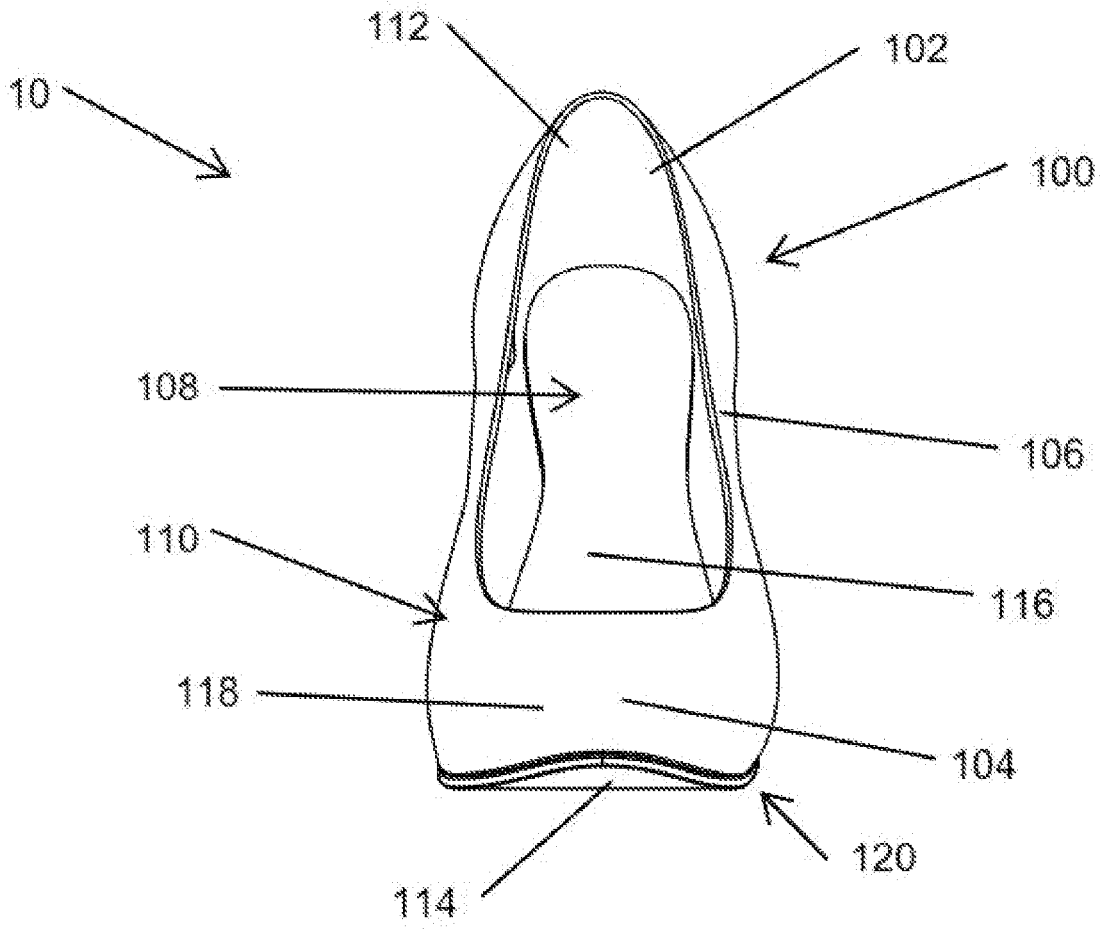
FIG. 4 is a front, elevation view of the footwear system with integrated orthotics, stabilization features, plurality of design features, and method of use; the view showing a footwear system and/or shoe and/or heeled shoe; the view showing an orthotic system in place within the shoe.
Figure 5:
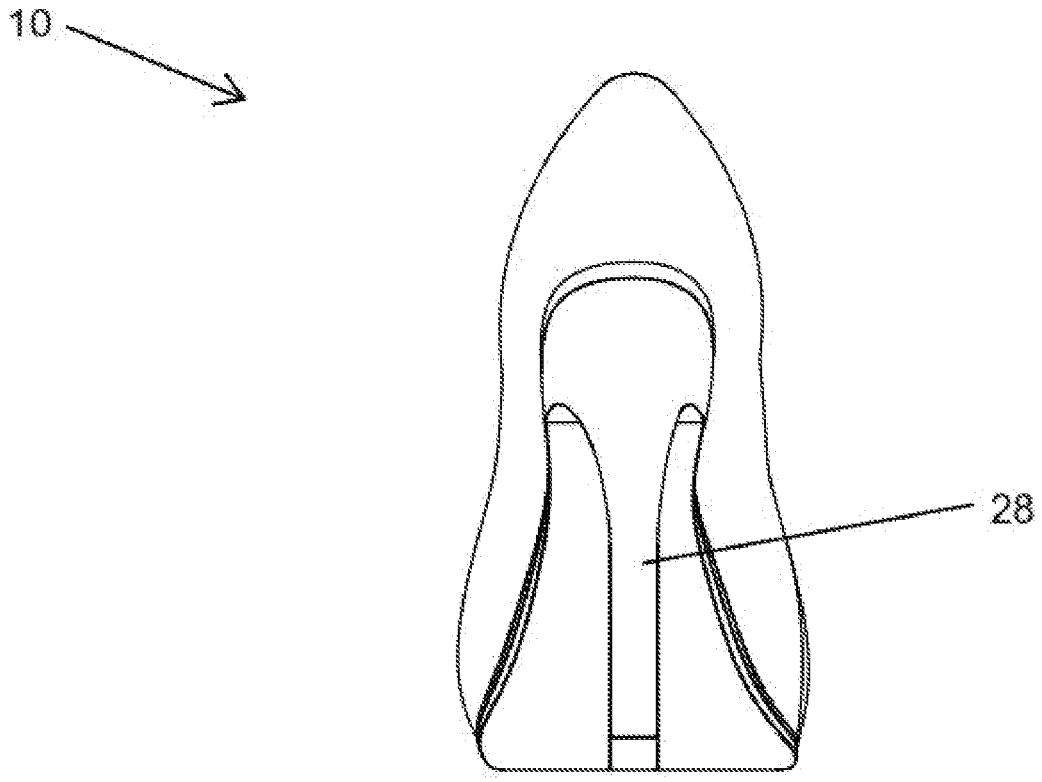
FIG. 5 is a rear, elevation view of the footwear system with integrated orthotics, stabilization features, plurality of design features, and method of use; the view showing a footwear system and/or shoe and/or heeled shoe.
Figure 6:
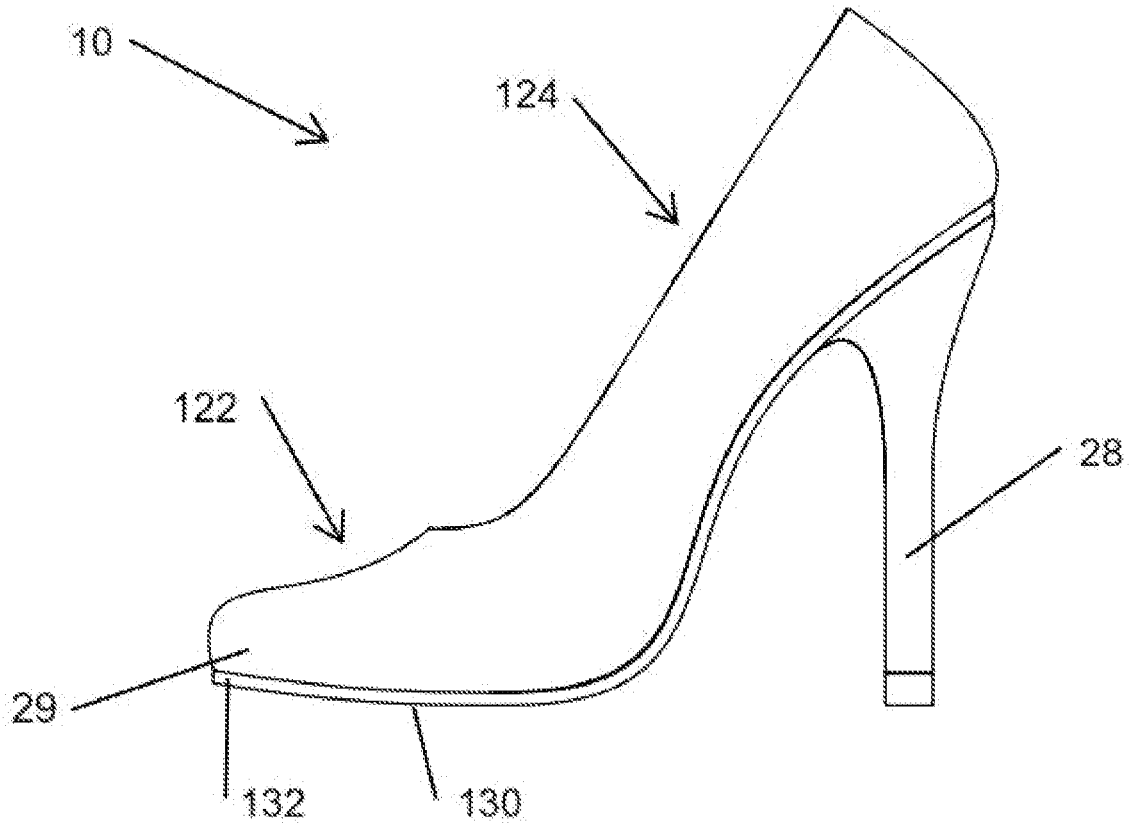
FIG. 6 is a side elevation view of the footwear system with integrated orthotics, stabilization features, plurality of design features, and method of use; the view showing a footwear system and/or shoe and/or heeled shoe.
Figure 7:
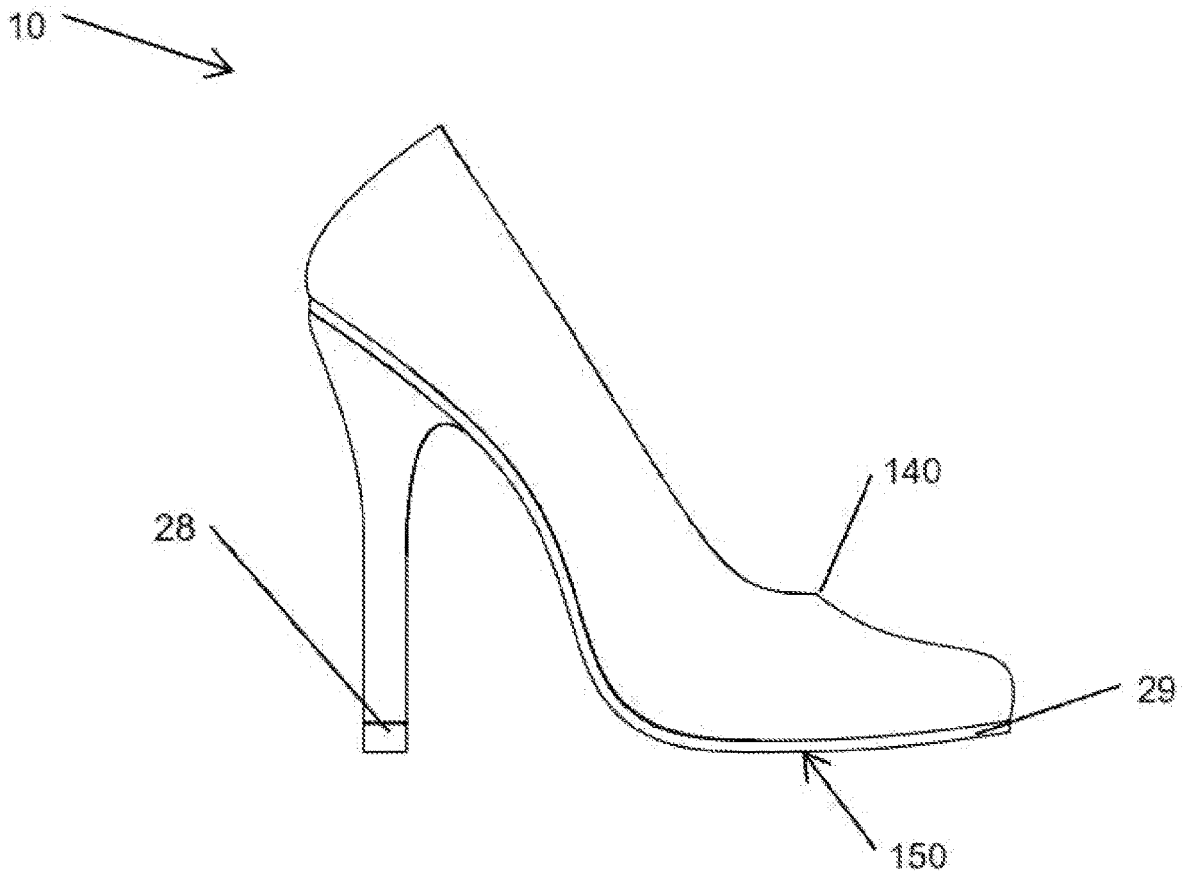
FIG. 7 is a side elevation view of the footwear system with integrated orthotics, stabilization features, plurality of design features, and method of use; the view showing a footwear system and/or shoe and/or heeled shoe.
Figure 8:
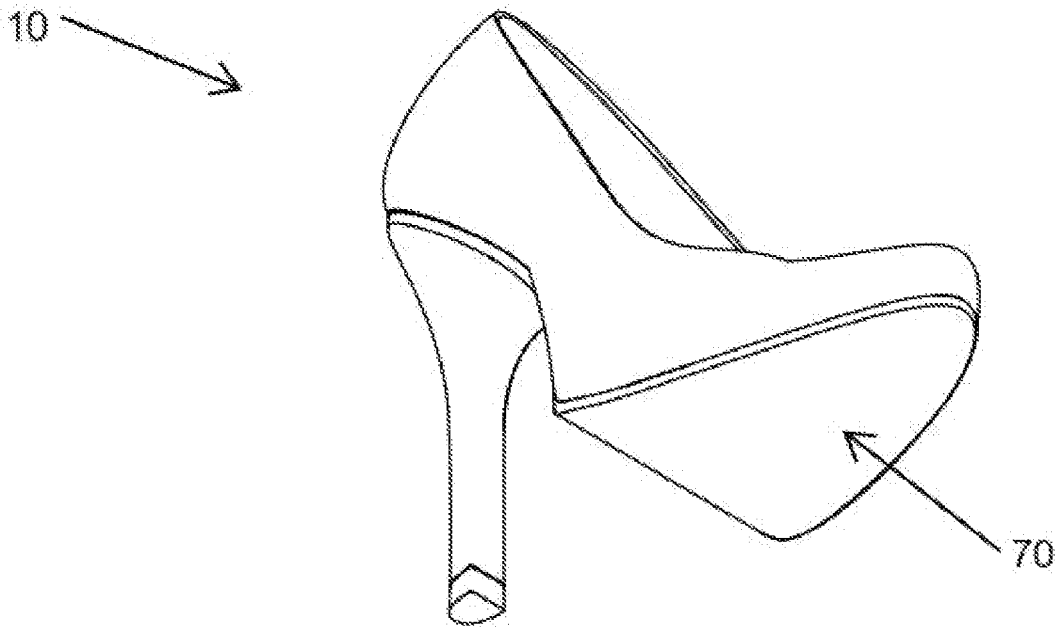
FIG. 8 is a bottom, perspective view of the footwear system with integrated orthotics, stabilization features, plurality of design features, and method of use; the view showing a footwear system and/or shoe and/or heeled shoe.
Figure 9:
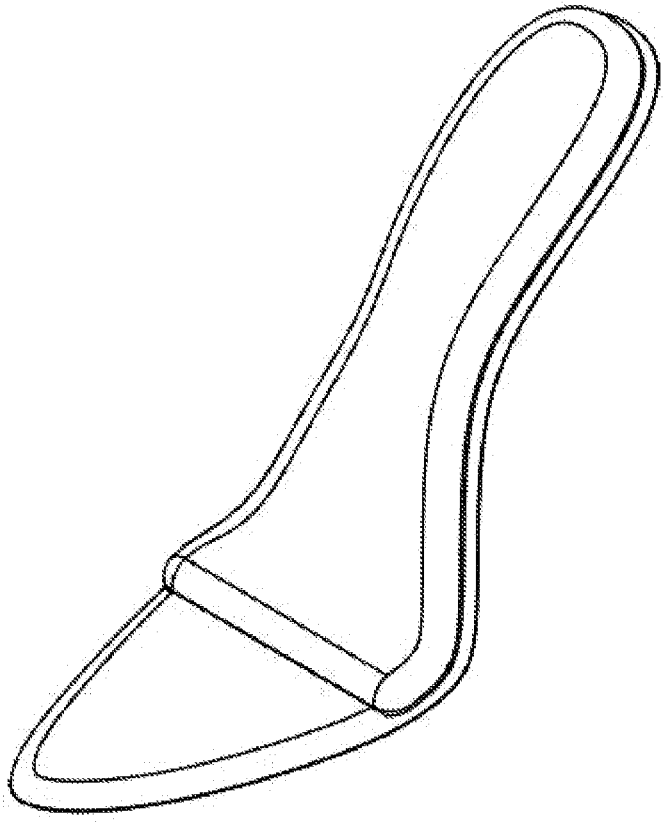
FIG. 9 is a top, perspective view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 10:
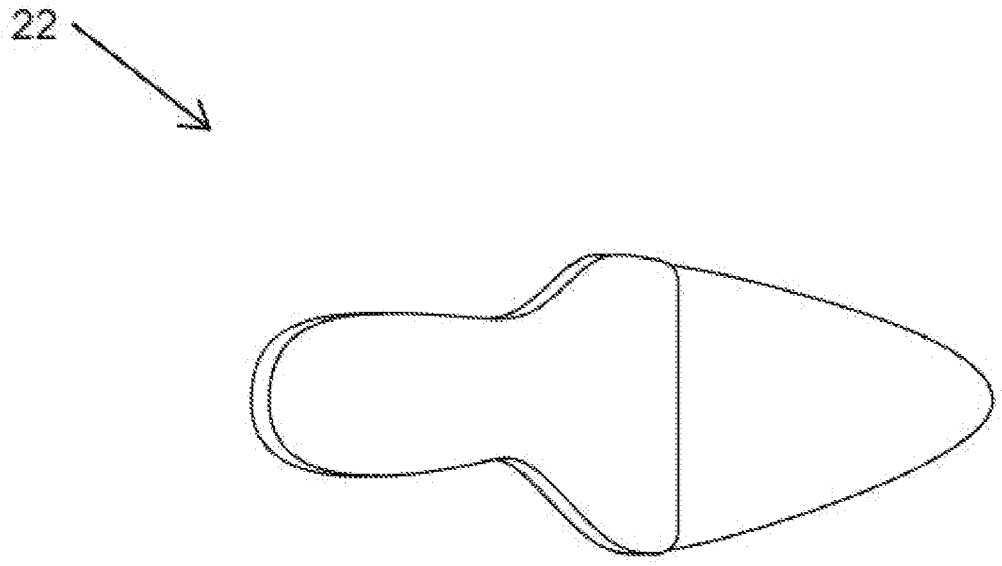
FIG. 10 is a top view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 11:
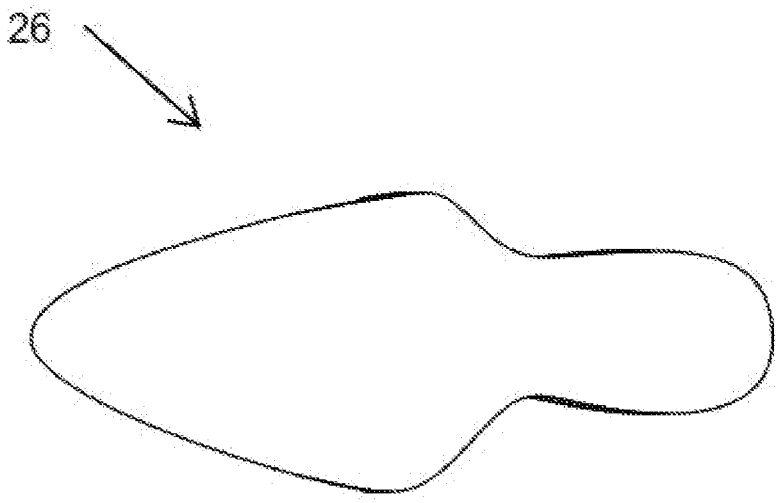
FIG. 11 is a bottom view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 12:
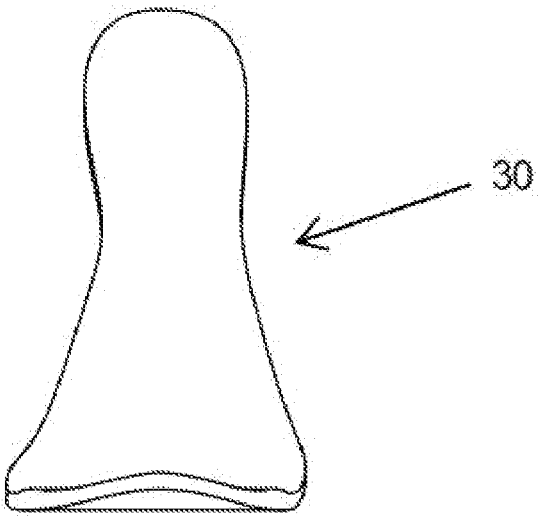
FIG. 12 is a front, elevation view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 13:
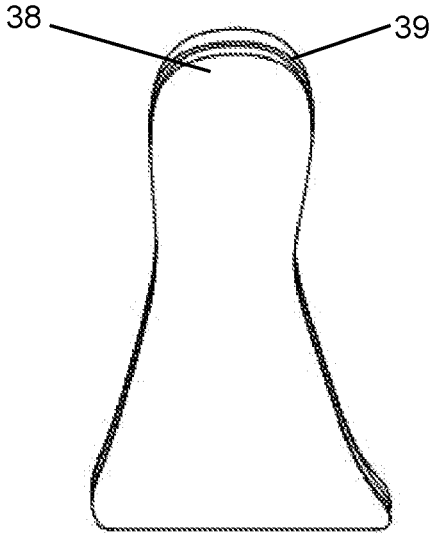
FIG. 13 is a rear, elevation view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 14:
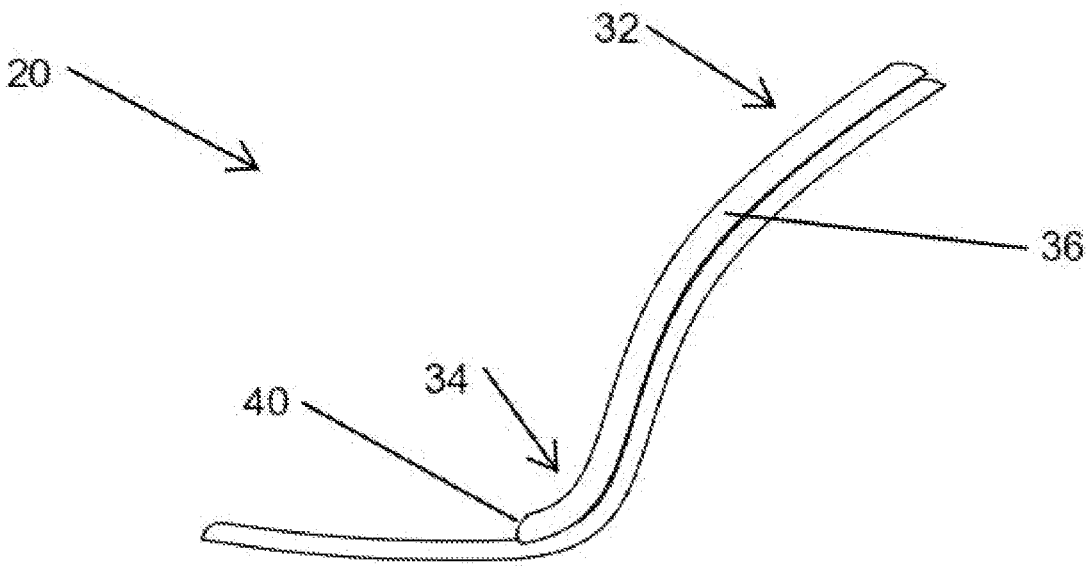
FIG. 14 is a side elevation view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 15:
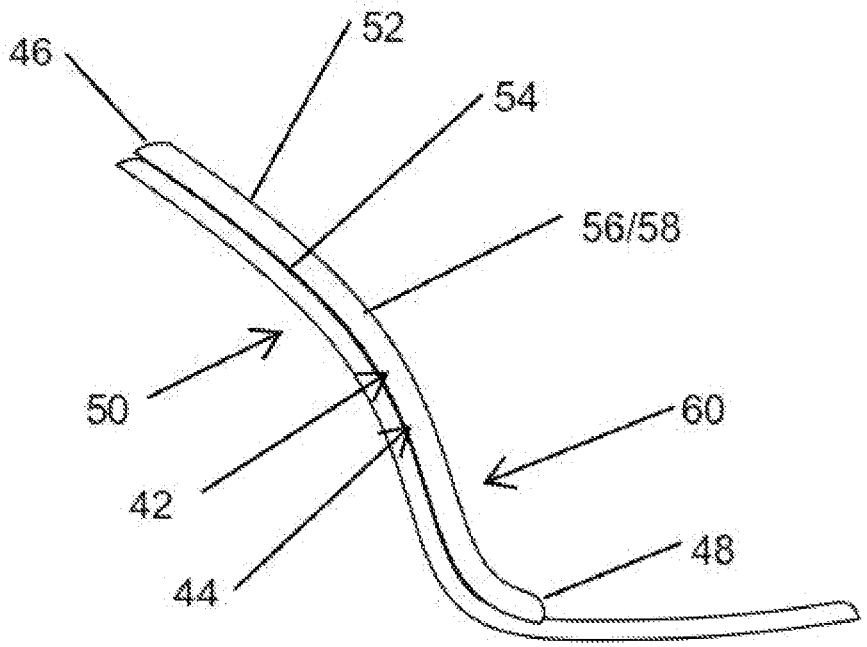
FIG. 15 is a side elevation view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 16:
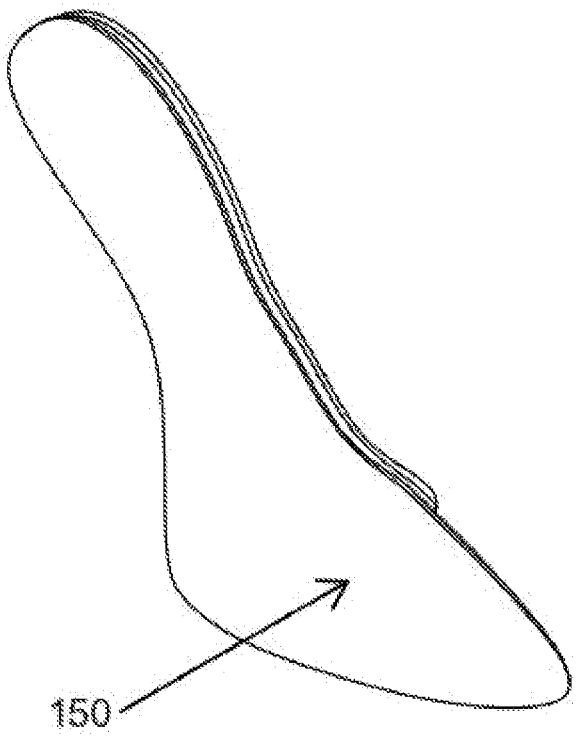
FIG. 16 is a bottom, perspective view of the footwear system with integrated orthotics, stabilization features, plurality of design features, and method of use; the view showing an orthotic system; the view showing a carbon fiber orthotic; the view showing a heel cup; the view showing a valley; the view showing a rim; the view showing an anterior rim; the view showing an arch incline.
Figure 17:
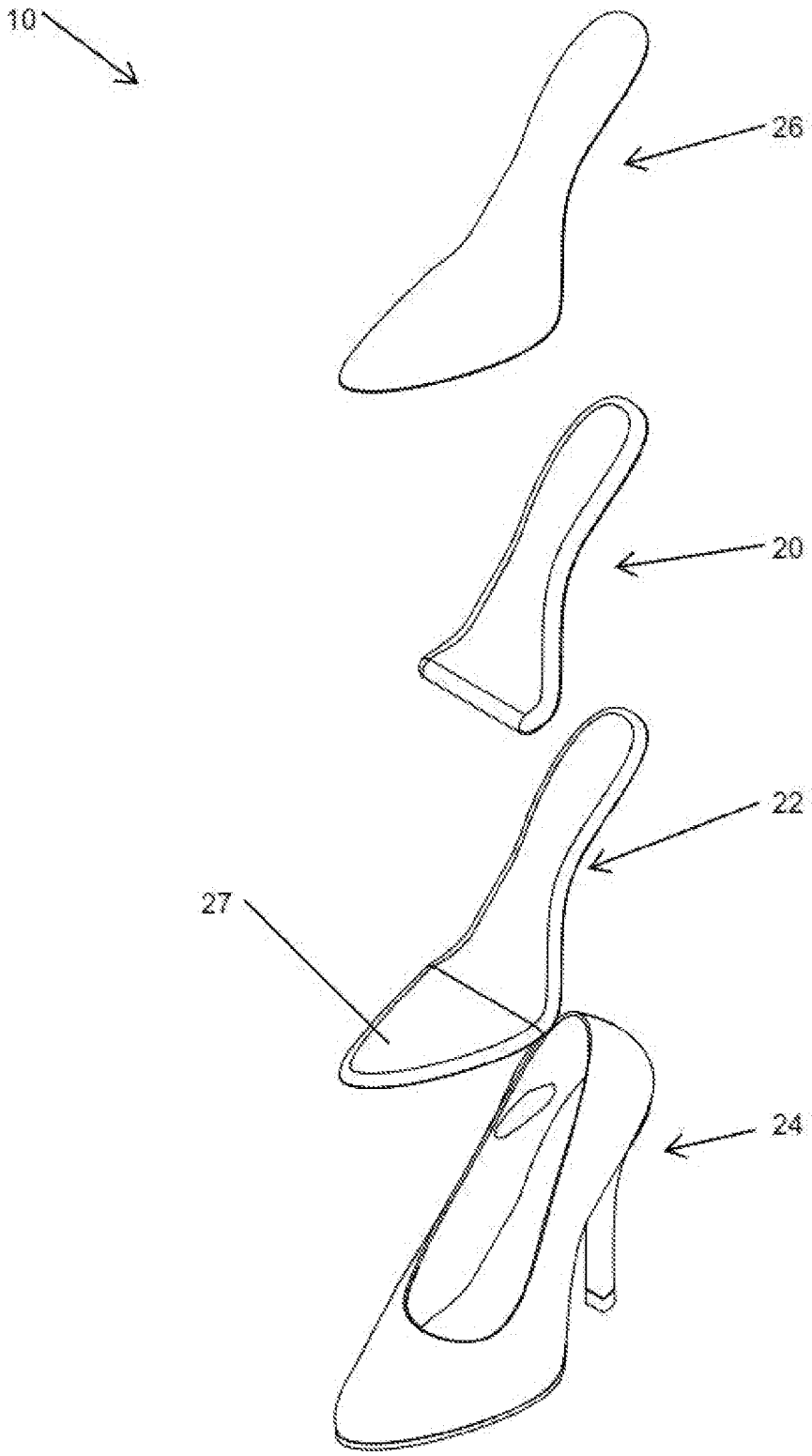
FIG. 17 is a top, perspective, exploded view of the footwear system with integrated orthotics, stabilization features, plurality of design features, and method of use; the view showing a footwear system and/or shoe and/or heeled shoe; the view showing an orthotic system in place within the shoe; the view showing an orthotic system; the view showing a carbon fiber orthotic; the view showing a heel cup; the view showing a valley; the view showing a rim; the view showing an anterior rim; the view showing an arch incline; the view showing a nose; the view showing an anti-slip feature.

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure (s). The following detailed description is, therefore, not to be taken in a limiting sense, and the scope of the disclosure(s) is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects may change without departing from the scope of the disclosure.

Reference throughout this specification to "one embodiment," "an embodiment," "one example," or "an example" means that a particular feature, structure, or characteristic described in connection with the embodiment or example is included in at least one embodiment of the present disclosure. Thus, the appearance of the phrases "in one embodiment," "in an embodiment," "one example," or "an example" in various places throughout this specification are not necessarily all referring to the same embodiment or example. Furthermore, the particular features, structures, databases, or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

All illustrations of the drawings are for the purpose of describing selected versions of the present disclosure and are not intended to limit the scope of the present disclosure.

Although the disclosure has been explained in relation to its preferred embodiment, it is to be understood that many other possible modifications and variations can be made without departing from the spirit and scope of the disclosure.

With reference to the figures, a footwear system with integrated orthotics, stabilization features, and a plurality of design features is presented. The footwear system is designed to solve well-known and long standing problems in the orthotic art and orthotic insert art. As one solution to these long existing problems, the footwear system is not bulky and does not hinder the ability of a user to use a shoe. As another solution to these long existing problems, the footwear system does not break down or lose integrity like existing orthotics. As yet another solution to these long existing problems, the footwear system, with a plurality of stabilization features, provides support, even in a high-heeled shoe. Another solution to these long existing problems, the footwear system and present disclosure solve various issues with modern orthotics and more.

Said another way, the present disclosure provides a footwear system with integrated orthotics, stabilization features, and a plurality of design features that is easy to use, that is aesthetically pleasing, that is comfortable, that is stable, that reduces the risk of injury of a user, and that does not slip and provides a high-heeled shoe solving these problems and more.

These long felt needs, other functionality, and additional features are some of the features presented herein with the footwear system with a plurality of features. These features, taken alone as an orthotic, as a footwear, as a plurality of innovations to a high-heeled shoes, or in combination present a novel footwear system, a novel orthotic system, and a plurality of novel designs which changes the state of the art and make using orthotics and a number of shoe types more comfortable, safe, easy, fun, and efficient. These features, other features, and a combination of these features will become more apparent from the description of the specification, claims, and other information presented herein.

System

With reference to the figures, a footwear system, stabilization features, and a plurality of design features 10 (or "footwear system", "orthotic system", or simply "system") is presented herein. Orthotic system 10 is formed of any suitable size, shape and design and is configured to provide a fashionable, comfortable footwear system that does not slip, that is comfortable, and that appears to be a normal shoe but has orthotics.

Said another way, the footwear system 10 provides an aesthetically pleasing, easy to use orthotic. The flexibility of the system not only allows a user to be comfortable and stabilized in an orthotic, but allows the user to wear a fashionable and aesthetically pleasing shoe during work hours, or after work hours, or at other times when engaging in weight-bearing activities. Not only does the system provide for instantaneous flexibility in orthotic use, but the system also provides for stabilization of the orthotic itself, stabilization of the foot within the orthotic, stabilization of the foot within the footwear, and reduction of injury through use of the footwear as compared to use with similar, common footwear.

In the arrangement shown, as one example, footwear system 10 includes a user, an orthotic system 20, a stabilization system 22, and a footwear system 24, among other components, features, systems, and functions.

Orthotic System

In the arrangement shown, as one example, system 10 includes an orthotic system 20. Orthotic system 20 is formed of any suitable size, shape, and design and is configured to provide support or brace the foot of a user. Said another way, orthotic system 20 is formed of a generally flat surface configured to provide support for the foot of user such that the foot of the user is supported consistently from the front to the back to the opposing sides, and throughout the arch. Furthermore, the orthotic system 20 is configured to provide this support throughout the weight-bearing activity whether the user is engaging in compressive forces, tensile forces, or a combination of both through complex movements.

In the arrangement shown, as one example, orthotic system 20 is specifically designed to work with complex footwear such that the orthotic system 20 is configured to support the foot of a user in a high-heel position. In this way, the foot of a user can still receive orthotic support even if the foot of the user is placed within the high-heeled footwear. To be more specific, and in the arrangement shown, as example, the high heeled position orthotic system 20 is formed to provide support needed for a user in the shape of a high-heeled shoe.

Orthotic system 20 may include, but is not limited to, a carbon fiber orthotic 30, a heel cup 32, a valley 34, a rim 36, a first layer 38, a second layer 39, an anterior rim 40, an interior 42, an exterior 44, a top 46, a bottom 48, an arch incline 50, a top of the arch incline 52, a bottom of the arch incline 54, opposing edges of the arch incline 56, an edge of the arch incline 58 and an incline angle 60.

In the arrangement shown, as one example, the concave heel cup includes a 4 degree medial arch inversion. However, other angles are hereby contemplated for use, including but not limited to, 1 degree medial arch inversion, 2 degree medial arch inversion, 3 degree medial arch inversion, 5 degree medial arch inversion, 6 degree medial arch inversion, 7 degree medial arch inversion, 8 degree medial arch inversion, 9 degree medial arch inversions, or medial arch inversions of greater degree.

In the arrangement shown, as one example, the incline angle is 46 degrees. However, other incline angles are hereby contemplated for use, including but not limited to an incline angle of 40-45 degrees, an incline angle of 35-40 degrees, an incline angle of 30-35 degrees, an incline angle of 25-30 degrees, an incline angle of 20-25 degrees, an incline angle of 15-20 degrees, an incline angle of 10-15 degrees, an incline angle of 5-10 degrees, or an incline angle of 0-5 degrees. Similarly, other incline angles are also hereby contemplated for use, including but not limited to an incline angle of 46-50 degrees, an incline angle of 50-55 degrees, an incline angle of 55-60 degrees, an incline angle of 60-65 degrees, an incline angle of 65-70 degrees, an incline angle of 70-75 degrees, or a larger incline angle.

Anti-Slip Feature: In the arrangement shown, as one example, the orthotics system includes an anti-slip feature 130. Anti-slip feature is formed of any suitable size, shape, and design and is configured to provide support for the orthotic, comfort for the orthotic, and stabilization for the orthotic. Said another way, the anti-slip feature 130 is designed and configured to keep the orthotic from moving within the footwear system. The anti-slip feature 130 also includes a nose which engages the footwear system during forces and the like to prevent slippage or movement of the orthotic system within the footwear system.

While carbon fiber is considered herein, in the arrangement shown, as one example, other materials are also hereby contemplated for use. Other materials may be polymers, enhanced polymers, a combination of cushioned materials and polymers, a combination of metals, alloys or any other material or combination thereof.

Footwear System

In the arrangement shown, as one example, system 10 includes a footwear system 100. Footwear system 100 (or "shoe system", "high heel system", or simply "high heel") is formed of any suitable size, shape, and design and is configured to provide a functional and aesthetic shoe and/or footwear which is fashionable but still aids a user in orthotic support. Said another way, the footwear system 100 is capable of integrating orthotics without giving the appearance of an orthotic while solving a plurality of other issues associated with orthotics.

In the arrangement shown, as one example, a unique set of modifications and design elements have been created to adapt a high heel shoe to accommodate the orthotic system disclosed herein. In the arrangement shown, as one example, footwear system 100 may extend from a first end 102 to a second end 104 having a generally elongated body 106. The body having an interior 108 and an exterior 110. The body having a heel 112 affixed closer to the first end 102 and a bottom 114 affixed and/or integrated nearer a second end 104. Additionally, the system 100 may include a built in sole or orthotic sole 116 within the interior as well as on the exterior. The system 100 may also include a nose 118, the nose 118 being closer to the second end and forming the second end in the arrangement shown, as one example. In the arrangement shown, as one example, the nose 118 is equipped with a toe spring 120. The toe spring located adjacent to the toe box 122 and/or forming a portion of the toe box 122. The toe spring is arranged such that the nose is positioned at angle of 15 degrees. In this way, the toe spring 120 provides a stabilized angle for the toe box and subsequently the toes of a user to make balancing optimized and easier. Additionally, and in the arrangement shown as one example, the toe box has been widened and elongated, and sized to appropriately house the orthotic system and/or the portion of the orthotic system 30 which will be affixed and/or inserted into the toe box 122. Additionally, the footwear system 100, in the arrangement shown as one example includes a grip feature 150 and an extended collar 140.

While an angle of 15 degrees is hereby contemplated for use and shown in the arrangement, as one example, other angles of toe spring adjustment are hereby contemplated and considered for use. Other angles for the toe spring include, but are not limited to, 0-5 degrees for the toe spring angle, 5-10 degrees for the toe spring angle, 10-15 degrees for the toe spring angle, 15-20 degrees for the toe spring angle, 20-25 degrees for the toe spring angle, 25-30 degrees for the toe spring angle, 30-35 degrees for the toe spring angle, 35-40 degrees for the toe spring angle, 40-45 degrees for the toe spring angle, and the like.

Likewise, while the orthotics system 100 shows a plurality of layers and discusses a first layer and a second layer, other numbers of layers are hereby contemplated for use. Other layers include a third layer, a fourth layer, a fifth layer, a sixth layer, a seventh layer, and eighth layer, a ninth layer, and more layers as may be integrated. Furthermore, while carbon fiber is used in at least one of the layers as is shown by example, the layers may be made of different types of materials.

Alternative Embodiment

In an alternative embodiment, and as is shown in the figures, system 10 discloses a uniquely designed and shaped footwear system 24 capable of including an orthotic 20 and stabilization system 22 without sacrificing design, appearance, and overall appeal of the shoe. In the arrangement shown, as one example, system 10 includes, but is not limited to, a footwear system 24, an insole board 26, an orthotic system 20, and an insole 22 (or "stabilization system").

Footwear System 24: In the alternative embodiment, as is shown, system 10 includes a footwear system 24. Footwear system 24 is formed of any suitable size, shape, and design and is configured to accommodate an orthotic while maintaining its unique aesthetically pleasing appearance. In the arrangement shown, as one example, footwear system 24 is uniquely shaped to accommodate the orthotic. This includes, but is not limited to an extended toebox collar which covers toe cleavage in addition to handling foot displacement caused by orthotics. In this way, the elongated toe collar or toe box can better accommodate comfort and orthotics while maintaining fashionable appearances.

Furthermore, the present disclosure and footwear system 24 is specifically shaped throughout the entire body of the shoe to accommodate an orthotic in a variety of ways including overall body shape, toe box shape, heel shape, sole shape, and the like. In this way, the unique shoe and molded shoe shape can comfortably and fashionably accommodate an orthotic for the first time without raising the foot of a user out of the shoe or creating a bulky shoe, or other awkward appearances caused by orthotic integration into shoes.

In the arrangement shown, as one example, a high-heeled (also referred to as a "stiletto") is shown. However, the heeled shoe may also be a wedge, a low-heeled shoe, a "flat", a pump, a platform shoe, a cone shoe, a mary jane type shoe, a peep shoe, a t-strap heeled shoe, an open toe heel shoe, a "d'orsay", a kitten, a shoe with an ankle strap, a chunky shoe, a ruby slipper type heeled shoe, a spool shoe, other raised heel type shoes, booties, and the like.

Heel Shapes of Footwear System: In the arrangement shown, as one example, the footwear system 24 includes a heel 28. Heel 28 is formed of any suitable size, shape, and design and is configured to support the heel of a user. In the arrangement shown, as one example, the heel 28 of the shoe is uniquely designed and shaped to enhance and increase stability for a user. In this unique design the heel regulates pressure more evenly across the foot and/or shoe of a user and/or that a user is wearing.

More specifically, and in an alternative embodiment not shown, the wedge design version takes pressure off of the arch of the foot of a user by uniquely and structural shifts of moving the load of the user to the heel of the user. In this way, the heel shapes of the present disclosure and alternative embodiments are specifically designed to enhance stability and increase and effectively transfer weight within the shoe itself. In this way, the footwear system 24, itself, can aid in comfort, and health of a user.

Nose Shape of Footwear System: In the arrangement shown, as one example, the footwear system 24 includes a nose rocker feature 29. Nose rocker feature 29 is formed of any suitable size, shape, and design and is configured to provide comfort, support, stabilization, and enhanced mobility for a user. Said another way, the subtle, specifically designed, nose rocker feature 29 is configured to make the footwear system 24 easier to walk in without sacrificing aesthetically pleasing features and design.

Said another way, the nose rocking feature 29 is formed of a very specific angle to be subtle and only for a particular portion of the toe box such that the nose rocker feature 29 does not change the design and/or appearance of the shoe while still providing support to the user as well as increased mobility and a rocking which can be executed during movement of a user. In this way, as a user is walking or moving about in this footwear system 24, the extra pressure onto the end of a toe and/or foot is dispersed during the walking and/or movement actions such that the mobility action is more comfortable for a user.

Furthermore, and in the arrangement shown, as one example, the full board and/or insole board 26 of system 10 shares a similar shape and a similarly shaped nose feature 27. In this way, the insole board 26 mimics the shape of the uniquely designed footwear system 24 to provide the mimicked support and mobility enhancements. Furthermore, the design and shape of the nose features 27/29 further prevent the appearance of an orthotic and/or enhanced shoe which can make some shoes unusable or undesirable in appearance. Said another way, the subtle edge provides for support and walking ease with aesthetic appeal.

Anti-Slip Feature of Footwear System: In the arrangement shown, as one example, the footwear system 24 includes an anti-slip feature 70. Anti-slip feature 70 is formed of any suitable size, shape, and design and is configured to provide grip on a surface and aid in comfort and stability of the footwear system 24. In the arrangement shown, as one example, the anti-slip feature is formed in a double apostrophe shape and makes up a portion of the bottom of the sole of the footwear system 24. However, other shapes and portions such as the entire bottom of the footwear system 24 are hereby contemplated for use.

Full Board: In the arrangement shown and as an alternative embodiment, the present disclosure includes a full board 26 (also referred to as an insole board). Insole board 26 is formed of any suitable size, shape, and design and is configured to provide a comfortable "sock" which sits between the foot of a user and the rest of the lower portions of the footwear system, the orthotic, and the half shell orthotic.

In the arrangement shown, as one example, the full board 26 extends the length of the sole of the footwear system 24 (the full board may also extend a portion of the full length). In the arrangement shown, the full board 26 includes an added foam and/or integrated foam located on the medial aspect. In the arrangement shown, as one example, this medial aspect foam provides support and stability for the arch of the foot of a user. In the arrangement shown, as one example, the foam is crescent in shape and is approximately 2 to 4 millimeters in thickness. Although, variations in thickness depend on the design of the footwear. Other thicknesses include 0 to 2 millimeters, 4 to 6 millimeters, 6 to 8 millimeters, or more. Similarly, the thickness may be even or may be graduated.

Orthotic of Footwear System: In the arrangement shown, as one example, system 10 includes an orthotic system 20 which is designed to fit within and designed with the overall footwear system 24. In this way, the orthotic system is configured to act as an orthotic without giving the footwear the appearance that an orthotic is being used, as this is undesirable.

In the arrangement shown, as one example, the orthotic system 20 extends the length of the footwear system and is designed and configured to fit within the interior. The orthotic system is formed of carbon fiber so as to be as thin as possible and further reduce the appearance that an orthotic is in use. Other materials may also be integrated into the orthotic such as padding and the like for comfort.

In the arrangement shown, as one example, additional padding is added at the forefoot of the orthotic to add comfort and aid in support and stabilization. Furthermore, the orthotic system 20 includes a dual-layered foam toebox, as well as a unique nose shape to aid in mobility. The nose shape is further described herein.

In the arrangement shown, as one example, the footwear system 24 also includes a half-shell orthotic. The half-shell orthotic provides support and stabilization and is configured to only extend a partial length of the footwear system 24.

This alternative embodiment may have these features in addition to or to replace some of the above features, as well as other features.

Alternative Embodiment

Figure 18:
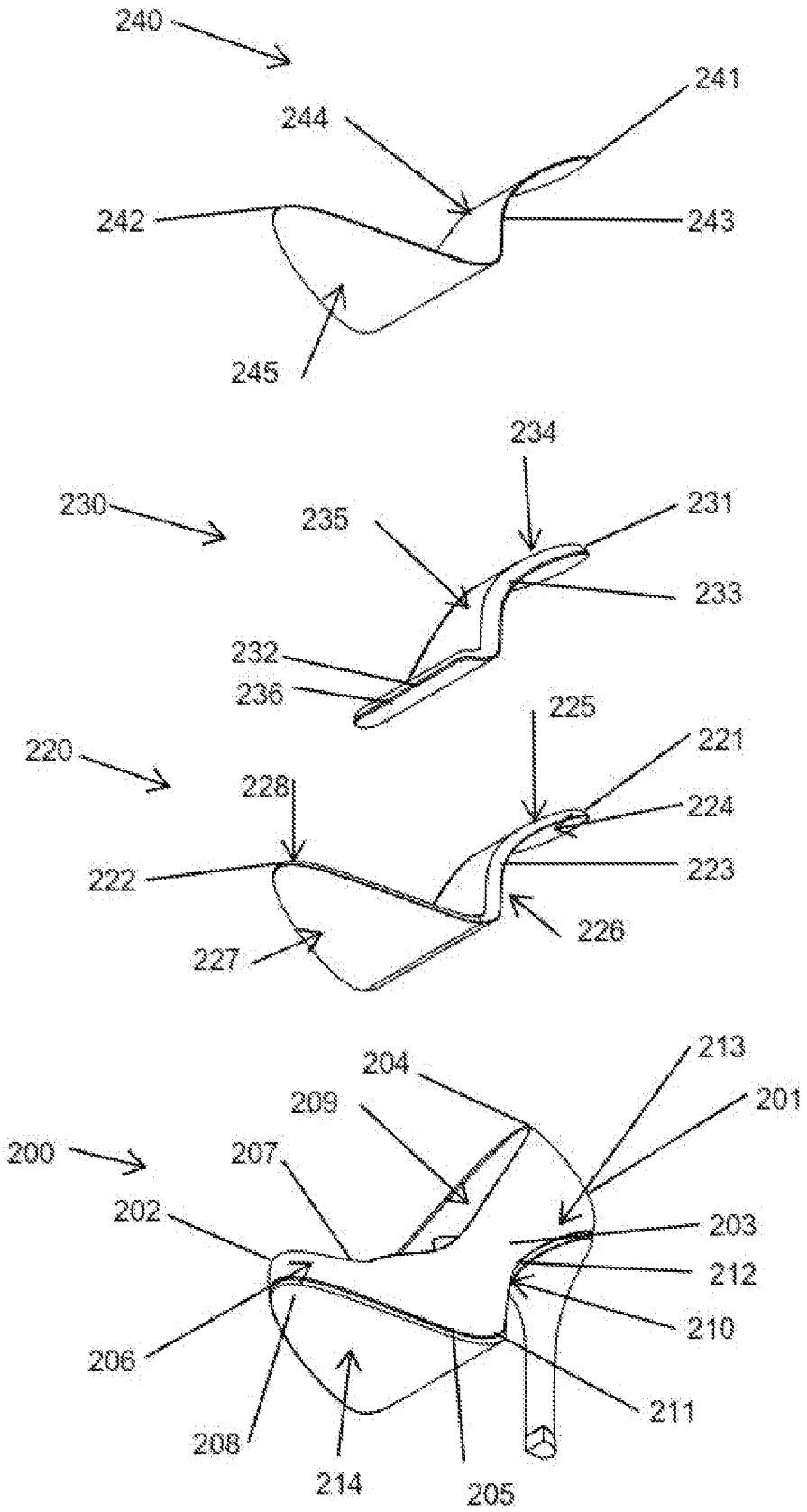
FIG. 18 is a bottom, perspective view of the footwear system with integrated orthotics, stabilization features, plurality of design features, and method of use; the view showing a footwear system and/or shoe and/or heeled shoe; the view showing an orthotic system in place within the shoe; the view showing an orthotic system; the view showing a carbon fiber orthotic; the view showing a heel cup; the view showing a valley; the view showing a rim; the view showing an anterior rim; the view showing an arch incline; the view showing a nose; the view showing an anti-slip feature.

In an alternative embodiment, and specifically with reference to FIG. 18, system 10 is a uniquely designed footwear system with integrated orthotics and an integrated insole. In this arrangement, the footwear is an all inclusive system constructed as a single unit without removable pieces. In this arrangement, the entire footwear system has been uniquely designed, shaped, and configured to provide an aesthetically pleasing appearance, similar to a regular shoe without an orthotic, while accommodating various support features and/or orthotic features, among other features.

In the arrangement shown, and particularly in an exploded view in FIG. 18, the footwear system 200 includes an integrated orthotic 220, a half shell orthotic 230, and an integrated insole 240, among other features.

In the arrangement shown, as one example, the footwear system 200 includes a footwear having first end 201, a second end 202, opposing sides 203, a top 204, a bottom 205, a toebox 206, a toebox collar 207, a toespring 208, an interior of the footwear 209, an angle of incline 210, a middle shank 211, a sole curvature 212, a widened heel cup 213 with a unilateral impregnated shape 214, and a grip feature 215, among other components and features.

In the arrangement shown, as one example, the footwear system with an integrated orthotic also includes an integrated orthotic 220. The integrated orthotic 220 is formed of any suitable size, shape, and design and is configured to provide support and stability for a user. The integrated orthotic 220 includes a first end 221, a second end 222, opposing sides 223, a heel support 224, an impregnated extension 225, an arch support 226, a toebox support 227, and a toespring 228, among other features.

In the arrangement shown, as one example, the footwear system with integrated orthotics also includes a half shell orthotic 230. Half shell orthotic 230 is formed of any suitable size, shape and design and is configured to provide support to the foot of a user. In the arrangement shown, as one example, the half shell orthotic 230 includes a first end 231, a second end 232, opposing sides 233, a heel support 234, an arch support 235, and a nose 236, among other components and features.

In the arrangement shown, as one example, the footwear system with integrated orthotics also includes an integrated insole 240. Integrated insole 240 is formed of any suitable size, shape, and design and is configured to provide comfort for a user. The integrated insole includes a first end 241, a second end 242, opposing sides 243, a medial aspect support 244, and may also include a toebox support 245, and may also include a heel support, and may also include an arch support feature, among other features and components.

In Operation

As one example, and in the arrangement shown, a footwear system with integrated orthotics, stabilization features, and design features is shown. The disclosure herein also considers methods of using these systems and features.

Additionally, and in alternative embodiments the orthotics system may be used with other footwear systems. Other footwear systems include, but are not limited to, tennis shoes, running shoes, designer shoes, boots, slips, slip-ons, slippers, and other footwear. In this way, the unique orthotics system disclosed herein can be adapted and integrated with other footwear systems.

It will be appreciated by those skilled in the art that other various modifications could be made to the device without parting from the spirit and scope of this disclosure. All such modifications and changes fall within the scope of the claims and are intended to be covered thereby.

What is claimed:

1. A footwear system with integrated orthotics, comprising:

a footwear;

the footwear extending a length from a first end to a second end between opposing sides;

the footwear having a top and a bottom;

an orthotics system;

the orthotics system extending a length from a first end to a second end between opposing sides;

the orthotics system having a rim;

the orthotics system having an orthotic wherein the orthotic provides stabilization and support for a foot of a user;

wherein the footwear is designed and shaped to fit the orthotics system;

a stabilization system;

the stabilization system having a toe box;

the stabilization system having a heel cup;

the stabilization system having an arch support;

wherein the stabilization system provides support to a foot of a user; wherein the stabilization system includes a thickened foam layer which lines up with an arch of the foot of the user;

wherein the toe box of the stabilization system provides support to a sole and toes of the user;

wherein the heel cup of the stabilization system provides support to a heel of the user;

wherein the arch support of the stabilization system provides support to the arch of the user;

an anti-slip feature;

the anti-slip feature located at the bottom of the footwear;

wherein the anti-slip feature prevents the heel cup of the orthotics system from moving in a downward direction;

wherein the anti-slip feature prevents the arch incline of the orthotics system from moving in a downward direction;

wherein the anti-slip feature causes contact with the interior of the footwear;

wherein the anti-slip feature prevents the orthotic system from slipping within the interior of the footwear;

wherein the arch support is made from carbon fiber;

an insole;

the insole extending a length from a first end to a second end between opposing sides;

wherein the insole is formed of a thin layer of material for comfort;

wherein the insole includes a second layer for additional comfort;

wherein the insole is formed to mimic the shape of the orthotics system;

the integrated orthotic having a toebox support;

the toebox support having a toespring;

wherein the toebox support having a dual-layered padding;

wherein the dual-layered padding is formed of a plurality of layers which provide support;

wherein the toespring is angled upward nearest the second end of the integrated orthotic so as to create a rocker feature which aids in mobility by providing an even distribution of pressure throughout the toebox support.

2. The system of claim 1, further comprising:

wherein the footwear is a high-heeled shoe;

wherein the heel cup is made from carbon fiber;

the insole having an integrated foam support.

3. The system of claim 1, further comprising:

the orthotics system having a first layer;

the orthotics system having a second layer;

wherein the anti-slip feature forms only a portion of the bottom of the footwear;

the anti-slip feature extending a length from a first end to a second end between opposing sides;

the anti-slip feature having a nose;

wherein the anti-slip feature is securely attached to the bottom of integrated orthotic system;

wherein the nose of the anti-slip feature causes contact with the footwear near the front of the arch support and prevent a half shell orthotic system from slipping downward;

wherein the anti-slip feature causes contact with the interior of the footwear;

wherein the anti-slip feature prevents the orthotic system from slipping within the interior of the footwear.

4. The system of claim 1, further comprising:

the arch support of the stabilization system having an arch incline;

wherein the arch incline has an upward curvature which provides support to an arch of a foot of a user;

the footwear having an elevated heel;

wherein when in a standing position on a flat surface, a heel of a foot of a user is in an elevated position relative to a set of toes of the user.

5. The system of claim 1, further comprising:

a toe spring;

wherein the toe spring is a curvature of the toe box which causes a user to be supported in an upward direction from the toe box;

wherein the curvature of the toe box provides resistance to sliding of a foot of the user in a forward direction;

the footwear having an extended collar;

wherein the extended collar provides a vertical extension of an exterior of the footwear;

wherein the extended collar increases the size of a footwear as a foot of a user is raised; the foot of the user being raised by placing the orthotics system into the footwear system.

6. The system of claim 1, further comprising:

wherein the toespring is angled upward nearest the second end of the integrated orthotic at a 15 degree dorsiflexed integration.

7. A footwear system with integrated orthotics, comprising:

a footwear;

the footwear extending a length from a first end to a second end between opposing sides;

the footwear having a top and a bottom;

the footwear being designed and shaped to accommodate an integrated orthotic;

wherein the footwear is designed and shaped to accommodate an integrated orthotic having an increased depth as measured from the bottom of the footwear to the top of the footwear to accommodate for an orthotic without raising a foot of a user out of an interior of the footwear;

an integrated orthotic;

the integrated orthotic extending a length from a first end to a second end between opposing sides;

the integrated orthotic having a heel support;

the integrated orthotic having an arch support;

a half shell orthotic;

the half shell orthotic having a heel support;

wherein the half shell orthotic provides heel support to the user;

the half shell orthotic providing arch support;

wherein the half shell orthotic provides arch support to the user;

an integrated insole;

the integrated insole extending a length from a first end to a second end;

wherein the integrated insole provides for a comfortable layer of separation between the integrated orthotic, the half shell orthotic, and the foot of the user;

wherein the integrated orthotic is made from carbon fiber;

the integrated orthotic having a toebox support;

the toebox support having a toespring;

wherein the toebox support having a dual-layered padding;

wherein the toespring is angled upward nearest the second end of the integrated orthotic so as to create a rocker feature which aids in mobility by providing an even distribution of pressure throughout the toebox support;

an anti-slip feature;

wherein the anti-slip feature prevents the heel cup of the orthotics system from moving in a downward direction;

wherein the anti-slip feature causes contact with the interior of the footwear near the heel cup;

wherein the anti-slip feature prevents the orthotic system from slipping within the interior of the footwear.

8. The system of claim 7, further comprising:

wherein the footwear is designed and shaped having an extended toebox collar;

wherein the extended toebox collar prevents toe cleavage.

9. The system of claim 7, further comprising:

wherein the footwear is designed and shaped having a toespring.

10. The system of claim 7, further comprising:

wherein the footwear is designed and shaped having a unique angle of incline strategically enhanced to slope comfortably while accommodating an integrated orthotic.

11. The system of claim 7, further comprising:

wherein the footwear is designed and shaped having a unique angle of incline strategically enhanced to slope comfortably while accommodating an integrated orthotic;

wherein the angle of incline of the footwear is 43-45 degrees.

12. The system of claim 7, further comprising:

wherein the footwear is designed and shaped having a unique angle of incline strategically enhanced to slope comfortably while accommodating an integrated orthotic;

wherein the footwear is designed and shaped having an elongated body to accommodate the change in slope.

13. The system of claim 7, further comprising:

the footwear having a middle shank;

wherein the middle shank is the portion of the footwear located where the toebox meets the arch;

wherein the footwear is designed and shaped having an increased width of a middle shank;

wherein the footwear is designed and shaped having a curvature built into the sole of the footwear;

wherein the footwear is designed and shaped having a widened heel cup wherein the widened heel cup is laterally extended in an impregnated shape.

14. The system of claim 7, further comprising:

the heel support having an impregnated extension; the impregnated extension extending laterally in one direction;

wherein the heel support and the impregnated lateral extension cause pressure to be more evenly and comfortably distributed.

15. The system of claim 7, further comprising:

the integrated insole having a raised thickness of padding at the medial aspect.

16. The system of claim 7, further comprising:

wherein the toespring is angled upward nearest the second end of the integrated orthotic at a 15 degree dorsiflexed integration.

17. A method of using a footwear system with integrated orthotics, comprising the steps:

providing a footwear system; the footwear system being a heeled shoe;

providing an orthotics system; the orthotics system having a stabilization system; the orthotics system having an attached anti-slip feature; the anti-slip feature having a nose;

wherein the anti-slip feature prevents the heel cup of the orthotics system from moving in a downward direction;

wherein the anti-slip feature prevents the arch incline of the orthotics system from moving in a downward direction;

wherein the anti-slip feature causes contact with the interior of the footwear;

wherein the anti-slip feature prevents the orthotic system from slipping within the interior of the footwear;

wherein the orthotics system is made of carbon fiber;

inserting the orthotics system into the footwear; the integrated orthotic having a toebox support; the toebox support having a toespring; wherein the toebox support having a dual-layered padding;

providing an extended collar for the footwear system to increase the height of the footwear system; wherein the toespring is angled upward nearest the second end of the integrated orthotic so as to create a rocker feature which aids in mobility by providing an even distribution of pressure throughout the toebox support; wherein the toespring is angled upward nearest the second end of the integrated orthotic at a 15 degree dorsiflexed integration;

providing the toe box of increased size to accommodate for the orthotics system;

providing a plurality of stabilization features; the stabilization features including a heel cup feature;

wearing the footwear system;

pressing in downward forces on the footwear system and orthotics system;

engaging the anti-slip feature so that the orthotic system does not move within the footwear system; wherein engaging the anti-slip feature includes the nose of the anti-slip feature pressing against a pivot point of the footwear system.

* * * * *